United States Patent [19]

Schnell

[11] 4,288,790

[45] Sep. 8, 1981

[54] FIRE ALARM

[75] Inventor: Walter Schnell, Herzogenbuchsee, Switzerland

[73] Assignee: Cerberus AG, Männedorf, Switzerland

[21] Appl. No.: 110,900

[22] Filed: Jan. 10, 1980

[30] Foreign Application Priority Data

Feb. 26, 1979 [CH] Switzerland ..... 1867/79

[51] Int. Cl.[3] ..... G08B 17/10

[52] U.S. Cl. ..... 340/628; 250/574; 340/630

[58] Field of Search ..... 340/628, 629, 630; 367/93, 94; 250/381, 574

[56] References Cited

U.S. PATENT DOCUMENTS

| | | | |
|---|---|---|---|
| 2,623,931 | 12/1952 | Bagno | 367/94 X |
| 2,655,645 | 10/1953 | Bagno | 367/94 X |
| 2,782,405 | 2/1957 | Weisz et al. | 367/94 X |

*Primary Examiner*—John W. Caldwell, Sr.
*Assistant Examiner*—Daniel Myer
*Attorney, Agent, or Firm*—Werner W. Kleeman

[57] ABSTRACT

In a fire alarm or detector where radiation in the visible or infrared spectral range, is transmitted in a pulsed mode in a measuring chamber, there is provided an acoustical receiver which collects the air pressure vibrations arising upon absorption of the radiation pulses by smoke or aerosol particles and evaluates them in coincidence with the radiation pulses. Upon exceeding a certain intensity of the acoustical pulses there is triggered a fire alarm signal. In this way it is particularly possible to positively detect smoke which is intensively radiation absorbent and with increased sensitivity within a measuring chamber having small dimensions. A further development of the invention contemplates the provision of an additional scattered radiation receiver, preferably registering smoke having markedly scattering properties for the radiation. The acoustical and the scattered radiation-evaluation channel are connected in an OR-circuit with the alarm signal transmitter. It is also preferable to use radiation having a wavelength in the range of the resonance radiation of a carbon oxide.

11 Claims, 2 Drawing Figures

FIRE ALARM

BACKGROUND OF THE INVENTION

The present invention relates to a new and improved construction of a fire alarm having a radiation source operated in a pulsed mode, the radiation source transmitting electromagnetic radiation to a measuring chamber which is accessible to air to be examined for the presence of smoke and aerosol particles.

Such fire alarms known also as optical smoke detectors, exploit the fact that the radiation, for instance, ultraviolet, visible light or infrared radiation, transmitted by a radiation source in a measuring chamber, is affected in a certain fashion upon presence of smoke particles or aerosols stemming from a combustion process in the measuring chamber.

Preferably, these fire alarms operate according to the principle of scattered radiation. There is provided a scattered radiation receiver which is not directly impinged by direct radiation, this receiver receiving radiation scattered by the smoke particles or the like and triggering a fire alarm signal as soon as the scattered radiation intensity exceeds a predetermined threshold. However, what is disadvantageous with such fire alarms is the fact that, they only respond to smoke which has a pronounced scattering effect upon the radiation, so-called white smoke, as for instance is formed during the combustion of moist or wet materials. They do not however respond to intensely radiation-absorbing smoke, and thus, in other words to smoke which only produces very little scattered radiation, so-called black smoke, as the same frequently is produced in the case of rapidly progressing fires or in the event of incomplete combustion processes. Heretofore known scattered radiation fire alarms are therefore not capable of reporting combustion processes of the type which are associated with the occurrence of markedly radiation-absorbent smoke, in other words black smoke. This is especially disadvantageous in the case of rapidly progressing fires, where the scattered radiation fire alarm frequently first triggers an alarm signal much too late in time.

Other heretofore known optical smoke detectors operate in accordance with the extinction principle. Here, a radiation receiver is directly irradiated by the radiation source. Upon the presence of smoke the irradiation thereof diminishes owing to the radiation absorption which occurs at the smoke particles and the radiation scattering. With a certain reduction in the irradiation of the radiation receiver there is triggered an alarm signal. Such fire alarms are capable of detecting even strongly absorbing, in other words black smoke, but however they require relatively large absorption paths, in the order of magnitude of one meter, if, as is necessary in practical applications, there should be detected with adequate sensitivity even small smoke densities. Therefore, such fire alarms are difficult to fabricate in the dimensions of at most ten centimeters which are needed in practical applications, if there are not to be used complicated, sensitive, expensive and dust-prone deflection mirror systems.

Extinction fire alarms are capable of detecting different types of smoke with relatively uniform sensitivity. However, they are associated with the limitation that a relatively small change of a relatively large irradiation value must be positively detected. In practical terms, this means that there is required an extremely good and correspondingly complicated and expensive long time stabilization of the radiation source. Therefore, in practice scattered light-fire alarms have found extensive acceptance in those situations where there is to be determined a deviation of a magnitude from null, something which can be accomplished much easier and without any great expenditure in equipment for stabilizing the radiation source. But, with this technique there must still be tolerated the drawback that such scattered light-fire alarms do not respond to all types of fires or combustion processes.

A further disadvantage which is associated with all heretofore known optical fire alarms resides in the fact that they only respond to smoke particles whose dimensions are greater than approximately those of the radiation wavelengths, i.e., greater than about $1\mu$. Smaller particles, which tend to form at the incipient stage of a fire, cannot be detected, so that such optical fire alarms frequently first then trip an alarm signal much too late in time. Consequently, it is therefore necessary to prefer other more rapidly responsive types of fire alarms, such as, for instance, ionization fire alarms. But ionization fire alarms are also afflicted with the shortcoming that it is necessary to use radioactive substances, which, in turn, again have other undesirable affects.

SUMMARY OF THE INVENTION

Therefore, with the foregoing in mind it is a primary object of the present invention to provide a new and improved construction of fire alarm which is not afflicted with the aforementioned drawbacks and limitations of the prior art constructions.

Another and more specific object of the present invention aims at overcoming the above-explained drawbacks of heretofore known optical fire alarms and to provide a new and improved construction of such type fire alarm which responds positively and with a rapid response behavior and greater sensitivity to the different types of combustion processes or fires which arise in practice, especially responding both to black and also white smoke and equally also to non-visible aerosol particles, and furthermore, which fire alarm is relatively simple in construction and possesses small dimensions.

Yet a further significant object of the present invention aims at providing a new and improved construction of fire alarm of the type described which is relatively simple in design, economical to manufacture, extremely reliable in operation, not readily subject to breakdown or malfunction, requires a minimum of maintenance and servicing, while affording early and positive detection of combustion processes of the most various types.

Now in order to implement these and still further objects of the invention, which will become more readily apparent as the description proceeds, the fire alarm of the present development is manifested by the features that there is provided an acoustical receiver which takes-up the air vibrations or oscillations generated by the absorption of the radiation pulses by the particles and is connected with an evaluation circuit which triggers a signal as soon as the intensity of such air vibrations exceeds a predetermined threshold.

With the present invention there is exploited the fact that due to the absorption of the radiation pulses, produced by the radiation source, by the particles in the radiation region, there is formed an air pressure pulse due to the momentary heating effect. The air pressure fluctuations produced during each radiation pulse are collected by an acoustical receiver and summed, and at the output of the acoustical receiver there appears in logic coincidence along with the radiation pulses an output pulse which is further processed by an evaluation circuit for giving an alarm signal.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
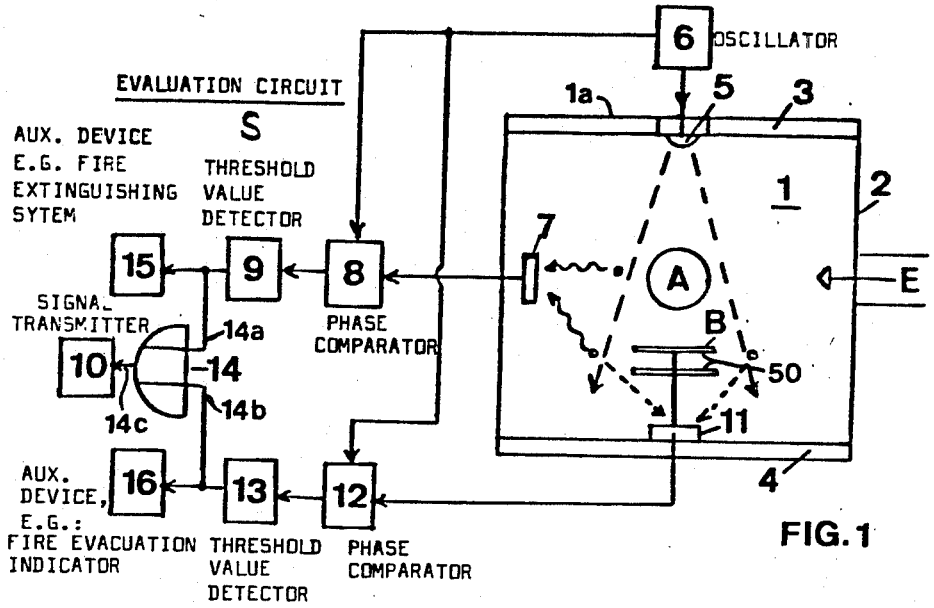
FIG. 1 is a longitudinal sectional view through the measuring chamber of a fire alarm and also showing suitable evaluation circuitry in block diagram.
Figure 2:
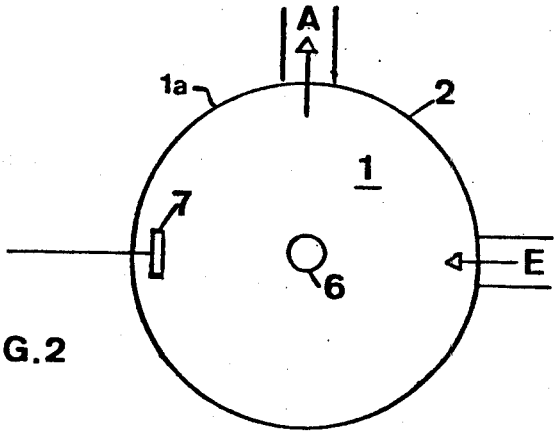
FIG. 2 is a cross-sectional view through the measuring chamber of the fire alarm of FIG. 1.

Describing now the drawings, the fire alarm illustrated in FIGS. 1 and 2 by way of example, will be seen to comprise a measuring chamber or compartment 1 enclosed in a housing, generally indicated by reference character 1*a*, which can comprise, for instance, a cylindrical or slightly conical wall 2, an upper cover 3 and a lower cover 4. Air has access to this measuring chamber or compartment 1 and which air is to be examined for the presence of smoke or combustion aerosols therein. Entry of the air into the housing 1*a* can be accomplished, for instance, by infeeding the air to be examined into the housing interior by means of an inlet opening E and allowing the air to depart from the housing through an exit or outlet opening A or by utilizing convection effects, wherein in the chamber wall 2 or in the lower cover 4 there can be provided suitable openings through which the ambient air can enter the measuring chamber 1. These openings can be formed in standard fashion as is known in this technology so as to be light impervious, in order to keep out the ambient light from the interior of the measuring chamber 1.

Located within the measuring chamber 1 at the upper cover member 3 is a suitable radiation source 5, for instance a laser or a light or infrared radiation-emitting diode. This radiation source 5 is operated in a pulsed mode by an oscillator 6 and transmits radiation pulses into the internal space or interior of the measuring chamber 1. These radiation pulses have a certain pulse frequency, typically for instance in a range between 1 and 20 kHz.

At another appropriate location of the measuring chamber 1 there is provided an acoustical receiver 7, for instance a conventional capacitive electret-microphone or pick-up containing electrically polarized foil. Now if smoke or combustion aerosols are located within the measuring chamber 1 then the radiation pulses are absorbed by the particles located within the radiation region. As a result these particles tend to heat-up briefly and there is formed an air pressure surge or wave by each particle. These individual pressure pulses sum-up and therefore can be detected by the acoustical receiver 7 as air vibrations or as pressure pulses or surges.

The occurrence of such air vibrations during a radiation pulse is an unmistakable sign that in the irradiated measuring chamber 1 there are present radiation absorbing particles. Moreover, it has been found that also particles which are smaller than the wavelengths of the radiation already contribute to this effect, i.e., that also aerosol particles which are formed at an incipient stage of a combustion process can be detected. To evaluate the air vibrations the acoustical receiver or pick-up 7 is connected with an evaluation circuit S. Initially, the output signal of the acoustical receiver 7 is infed to a phase comparator 8, for instance a transistorized amplifier having appropriate input resistance, this phase comparator 8 being controlled in coincidence with the radiation source 5 by the oscillator 6. In this way there is achieved the result that only during the pulse duration of the radiation pulses is there evaluated the signals delivered by the acoustical receiver 7 and further transmitted to the subsequently connected threshold value detector 9. As soon as the intensity of the output pulse of the acoustical receiver 7 has exceeded a certain threshold, this threshold value detector 9 delivers an alarm signal to the signal transmitter 10 which is controlled by the detector 9. It is possible in conventional fashion, just as holds true for other optical fire alarms, to incorporate into the circuit design integration or time-delay elements, so as to avoid faulty alarm tripping by individual pulses. Moreover, there can be employed conventional techniques known for avoiding spurious transient pulses in order to suppress the transient behavior, for instance in the phase comparator 8. The evaluation circuit contains conventional circuit components as are well known in the electronics art, and exemplified for instance by U.S. Pat. Nos. 3,917,956; 3,946,241; 4,163,969; and British Patent Publication No. 2,017,994A, to which reference may be had and the disclosure of which is incorporated herein by reference.

It has been found to be particularly advantageous if the pulse frequency of the radiation pulses, in other words the frequency of the oscillator 6 and the dimensions of the measuring chamber 1 are coordinated to one another such that in the measuring chamber 1 there are formed standing acoustical waves. With a cylindrical measuring chamber 1 having a diameter of 5 centimeters, for instance the lowest cylinder symmetrical resonance frequency is at 8.2 kHz. It is possible to equally excite and use other resonance oscillations with other frequencies, but as a rule they are somewhat more markedly dampened and hence deliver a correspondingly weaker signal. Owing to the arising resonance it is possible in any event to obtain an appreciable amplification of the signal at the acoustical receiver 7.

Particularly favorable dimensions, as required in practice of fire alarms, can thus be realized for instance as previously explained if there is used a radiation pulse frequency in the order of magnitude of 8 kHz. Surprisingly it has been found that notwithstanding extremely small dimensions of the measuring chamber 1 the acoustical receiver 7 delivers such a large output signal that it is possible, in a most simple manner, to evaluate the same free of any disturbances. Therefore, it is possible to dimension the measuring chamber so as to be smaller by at least one order of magnitude than such would be conventional in the case of extinction fire alarms, without, as is usual in the case of extinction fire alarms, it being necessary to exactly adjust a multiplicity of sensitive and dust-prone deflection mirrors. Nonetheless with the described arrangement it is possible to detect particularly markedly absorbing, i.e. black smoke with surprisingly great sensitivity.

In order to be able to additionally detect even less markedly absorbing smoke particles, which only cause radiation scattering, for instance particles containing water vapor or white smoke, a further development of the invention has found that it is advantageous to additionally provide a radiation receiver 11 in the measuring chamber 1. This arrangement can be accomplished for instance in accordance with the smoke detectors disclosed in Swiss Pat. No. 592,932 and the corresponding U.S. patent application Ser. No. 777,397, filed Mar. 14, 1977, now U.S. Pat. No. 4,181,439, to which reference may be readily had and the disclosure of which is incorporated herein by reference. There is disclosed therein various constructions of smoke detectors wherein the radiation source 5 possesses a conical ring-shaped radiation characteristic and the radiation receiver 11 is arranged in the cone axis, but externally of the direct radiation region. Additionally, the radiation receiver 11 is screened from the direct radiation by a diaphragm system B, for instance for keeping away the scattered radiation at the edges there is provided a double diaphragm or screening arrangement 50 as shown in FIG. 1.

This scattered radiation receiver 11 is connected with a further phase comparator 12, likewise controlled by the oscillator 6. This phase comparator 12, like the first phase comparator 8, amplifies the incoming signal in coincidence logic with the radiation pulses and delivers such to a second threshold value detector 13. As soon as the intensity of the output signal of the scattered radiation receiver 11 exceeds a further threshold, during the duration of the radiation pulses, the threshold value detector 13 likewise controls a signal transmitter. This signal transmitter can be the same signal transmitter as shown in FIG. 1 by reference character 10 and which is controlled by the output signal of the acoustical receiver 7, and the threshold value detectors 9 and 13 of both channels are each connected with the inputs 14*a* and 14*b* of an OR-gate or element 14 or an appropriate circuit, at the output 14*c* of which there is connected the common fire alarm-signal transmitter 10. In each of both channels there however also can be separately controlled predetermined signal transmitters or auxiliary devices, the triggering of which is advantageously accomplished depending upon the occurrence of a certain type of smoke. For instance, by means of the acoustical evaluation channel, which preferably should respond in the case of rapidly propogating fires, there can be controlled a fire extinguishing system 15, whereas by means of the scattered radiation channel, preferably responsive to the occurrence of white smoke, there can be actuated a fire escape or evacuation indicator device 16 due to the prevailing blinding smoke. Both of the additional auxiliary devices 15 or 16 can however also be designed as separate signal transmitters, in order to be able to recognize at a central signal station what type of smoke is being reported, i.e., the nature of the type of fire. In this way, i.e., by incorporating an acoustical evaluation channel in the mentioned scattered radiation smoke detector it is possible to provide a universally employable fire alarm, capable of positively and rapidly detecting with increased sensitivity all of the different types of fires which arise in practice. Moreover, the dimensions of the fire alarm can be maintained extremely small and there is no danger that there need be used radioactive substances.

The invention still can be further expanded upon in that the wavelengths of the employed radiation can be chosen to be in the range of the resonance radiation of a carbon oxide, for instance carbon dioxide or also carbon monoxide. In this respect there is suitable as the radiation source, for instance a semiconductor-laser which preferably lies in the wavelength range of such resonance radiation, for instance at 4.7 μm 4.3 μm or 2.7 μm. Found to be particularly suitable are three metal laser diodes, for instance containing the composition $(Pb_{1-x}\ Sn_x)$ Te or $(Pb_{1-x}Sn_x)$ Se. Further advantageous laser diodes are those having the composition Ga $(As_x\ P_{1-x})$ and $(Cd_x\ Hg_{1-x})$ Te, also Pb S Se has been found as a suitable diode for generating radiation in the range of 4 to 8.5 μm. The advantage of using a radiation of this spectral composition resides in the fact that it also is absorbed by carbon oxide-molecules in the measuring chamber. It has been found that upon the occurrence of carbon oxide there is likewise synchronously generated with the radiation pulses pressure waves in the measuring chamber, which equally can be recorded by the acoustical receiver 7. Also the presence of carbon oxide in the air thus leads to triggering of a signal. Since in the case of a fire, as a general rule, there are formed, apart from other combustion products, also carbon oxide, it is anyway extremely desirable to detect carbon oxide by means of a fire alarm.

While there are shown and described present preferred embodiments of the invention, it is to be distinctly understood that the invention is not limited thereto, but may be otherwise variously embodied and practiced within the scope of the following claims. Accordingly,

What I claim is:

1. A fire alarm comprising:

a measuring chamber accessible to air to be monitored for the presence of smoke and aerosol particles;

a radiation source operated in a pulsed mode for transmitting electromagnetic radiation in the measuring chamber;

an acoustical receiver for taking-up air vibrations produced by the absorption of radiation pulses by the particles; and an evaluation circuit connected with said acoustical receiver for delivering a signal as soon as the intensity of the air vibrations exceeds a predetermined threshold.

2. The fire alarm as defined in claim 1, further including:

electrical oscillator means for operating the radiation source in a pulsed mode;

said electrical oscillator means controlling the radiation source by means of a predetermined pulse frequency and simultaneously operating the evaluation circuit in coincidence with the radiation pulses.

3. The fire alarm as defined in claim 2, wherein:

said evaluation circuit comprises a phase comparator;

said phase comparator being controlled by said electrical oscillator means;

said phase comparator evaluating an output signal of the acoustical receiver essentially only during the duration of the radiation pulses;

a threshold value detector in circuit with the phase comparator;

a signal transmitter in circuit with the threshold value detector; and said threshold value detector delivering a signal to the signal transmitter as soon as the intensity of the output signal of the acoustical receiver exceeds a predetermined threshold.

4. The fire alarm as defined in claim 2, wherein:

said measuring chamber is dimensioned such that at the pulse frequency chosen for operation of the radiation source there are present within the measuring chamber standing acoustical waves.

5. The fire alarm as defined in claim 4, wherein:

said pulse frequency of the radiation source is in the range of between 1 and 20 kHz.

6. The fire alarm as defined in claim 5, wherein:

said pulse frequency is in the order of about 8 kHz.

7. The fire alarm as defined in claim 1, further including:

a scattered radiation receiver for receiving radiation scattered by smoke particles within the measuring chamber in a radiation region of the radiation source;

means for essentially precluding the scattered radiation receiver from receiving direct radiation from the radiation source; and said scattered radiation receiver delivering a signal as soon as the intensity of the receiver scattered radiation exceeds a predetermined threshold.

8. The fire alarm as defined in claim 7, wherein:

said evaluation circuit comprises a phase comparator;

said phase comparator being controlled by said electrical oscillator means;

said phase comparator evaluating an output signal of the acoustical receiver essentially only during the duration of the radiation pulses;

a threshold value detector in circuit with the phase comparator;

a signal transmitter in circuit with the threshold value detector;

said threshold value detector delivering a signal to the signal transmitter as soon as the intensity of the output signal of the acoustical receiver exceeds a predetermined threshold;

said scattered radiation receiver being connected with the evaluation circuit; and said evaluation circuit containing a further phase comparator controlled in coincidence with said electrical oscillator means and a further threshold value detector controlling said signal transmitter as soon as the output signal of the scattered radiation receiver exceeds a predetermined threshold.

9. The fire alarm as defined in claim 8, wherein:

said evaluation circuit means comprises an OR-circuit having inputs and an output;

the inputs of said OR-circuit being controlled by respective ones of said threshold value detectors; and said output of said OR-circuit controlling the signal transmitter.

10. The fire alarm as defined in claim 8, further including:

auxiliary means directly controllable by the output signals of the threshold value detectors.

11. The fire alarm as defined in claim 1, wherein:

said radiation source transmits radiation in a wavelength range of the resonance radiation of a carbon oxide.

* * * * *